US009522779B2

(12) United States Patent
Brooks

(10) Patent No.: US 9,522,779 B2
(45) Date of Patent: Dec. 20, 2016

(54) TRASH CONTAINER CONCEALMENT SYSTEM

(71) Applicant: Howard H. Brooks, Houston, TX (US)

(72) Inventor: Howard H. Brooks, Houston, TX (US)

( * ) Notice: Subject to any disclaimer, the term of this patent is extended or adjusted under 35 U.S.C. 154(b) by 24 days.

(21) Appl. No.: 14/608,771

(22) Filed: Jan. 29, 2015

(65) Prior Publication Data

US 2016/0221751 A1 Aug. 4, 2016

(51) Int. Cl.

| | |
|---|---|
| ***B65D 25/00*** | (2006.01) |
| ***B65D 1/40*** | (2006.01) |
| ***B65D 3/28*** | (2006.01) |
| ***B65F 1/14*** | (2006.01) |
| ***B65F 1/02*** | (2006.01) |

(52) U.S. Cl.

CPC ..... *B65F 1/1426* (2013.01); *B65F 1/02* (2013.01); *B65F 1/1646* (2013.01)

(58) Field of Classification Search

CPC ..... E04H 1/1205; E04H 6/00; E04H 17/00; E04B 2/74; B65F 1/1426; B65F 1/02; B65F 1/1646

USPC ..... 220/730, 731, 480, 23.87; 52/3, 5, 211, 52/212, 27, 36.1, 38, 79.1; 135/904; 256/1, 19

See application file for complete search history.

(56) References Cited

U.S. PATENT DOCUMENTS

| | | | | |
|---|---|---|---|---|
| 2,051,381 | A * | 8/1936 | Kivlin | B61D 45/001 24/265 CD |
| 3,170,587 | A | 2/1965 | Beeber | |
| 3,596,418 | A * | 8/1971 | Sedwick, Jr. | B65F 1/1426 52/125.4 |
| 3,647,102 | A | 3/1972 | Cooley | |
| 3,984,941 | A | 10/1976 | Chetta, Jr. | |
| D309,208 | S | 7/1990 | Cajigas | |
| D416,657 | S | 11/1999 | Compitello | |
| 6,341,713 | B1 * | 1/2002 | Kilmer | B65F 1/14 150/154 |
| 6,807,782 | B2 * | 10/2004 | Forman | E04F 19/00 40/607.03 |
| 6,978,576 | B2 * | 12/2005 | Shirk | E05D 3/022 220/908 |
| 7,836,653 | B1 * | 11/2010 | Herrington | F24F 1/58 256/25 |
| 8,480,043 | B1 * | 7/2013 | Ventura | B65F 1/141 248/156 |
| 2005/0076980 | A1 | 4/2005 | Hamdan | |
| 2006/0169696 | A1 * | 8/2006 | Taylor | B65D 55/16 220/326 |
| 2010/0170903 | A1 | 7/2010 | Stegeby | |
| 2011/0146175 | A1 * | 6/2011 | Forsberg | B44C 5/0453 52/309.1 |
| 2013/0277633 | A1 * | 10/2013 | Goode | E04H 17/18 256/25 |

* cited by examiner

*Primary Examiner* — Jacob K Ackun
*Assistant Examiner* — Rafael Ortiz

(57) ABSTRACT

A trash container concealment system for concealing a trash container includes a trash container that has a body and a lid hingedly coupled to the body. A shielding apparatus is provided to be positioned around the trash container thereby concealing the trash container.

2 Claims, 4 Drawing Sheets

TRASH CONTAINER CONCEALMENT SYSTEM

BACKGROUND OF THE DISCLOSURE

Field of the Disclosure

The disclosure relates to concealment devices and more particularly pertains to a new concealment device for concealing a trash container.

SUMMARY OF THE DISCLOSURE

An embodiment of the disclosure meets the needs presented above by generally comprising a trash container that has a body and a lid hingedly coupled to the body. A shielding apparatus is provided to be positioned around the trash container thereby concealing the trash container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
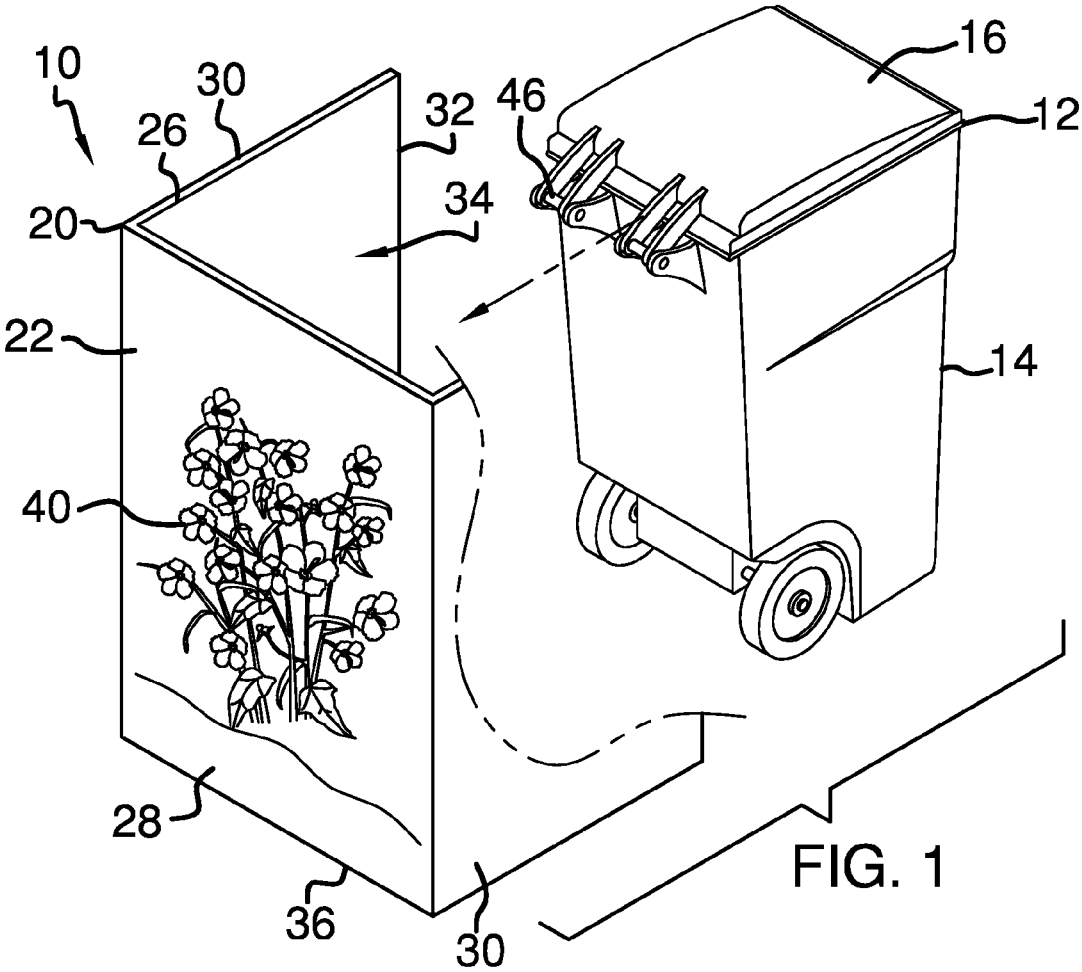
FIG. 1 is a perspective in-use view of a trash container concealment system according to an embodiment of the disclosure.
Figure 2:
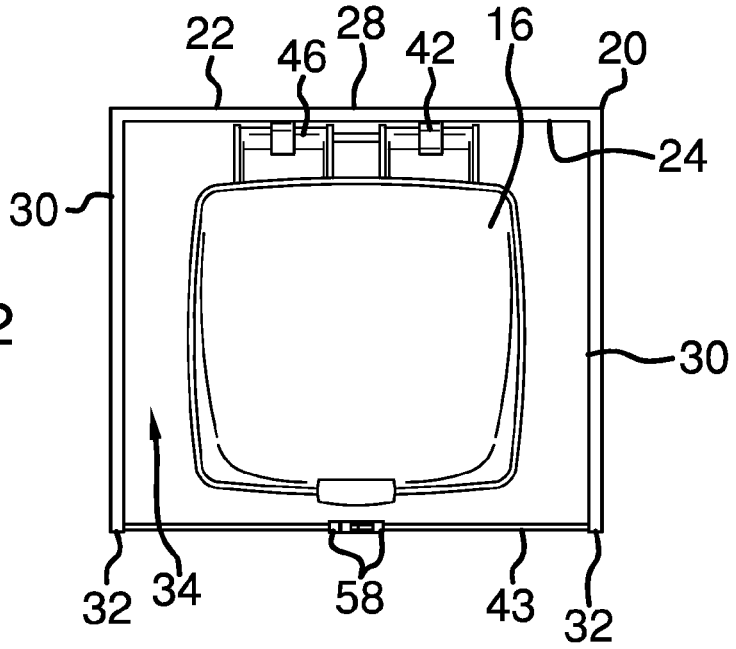
FIG. 2 is a top view of an embodiment of the disclosure.
Figure 3:
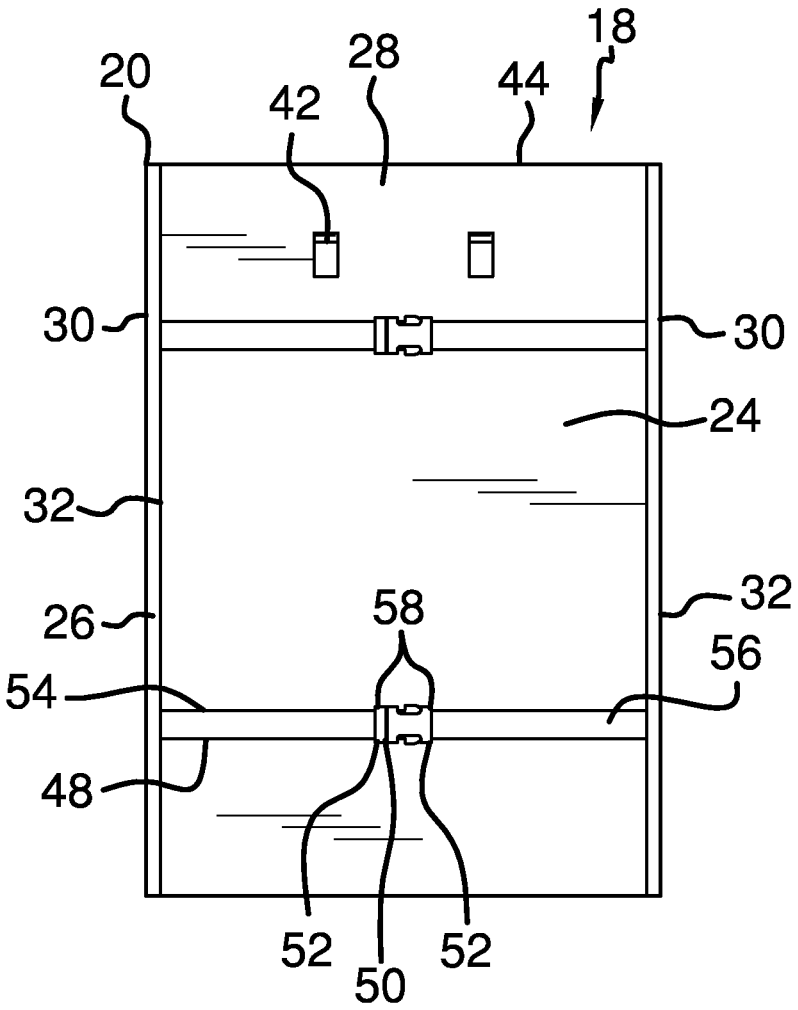
FIG. 3 is a back view of an embodiment of the disclosure.
Figure 4:
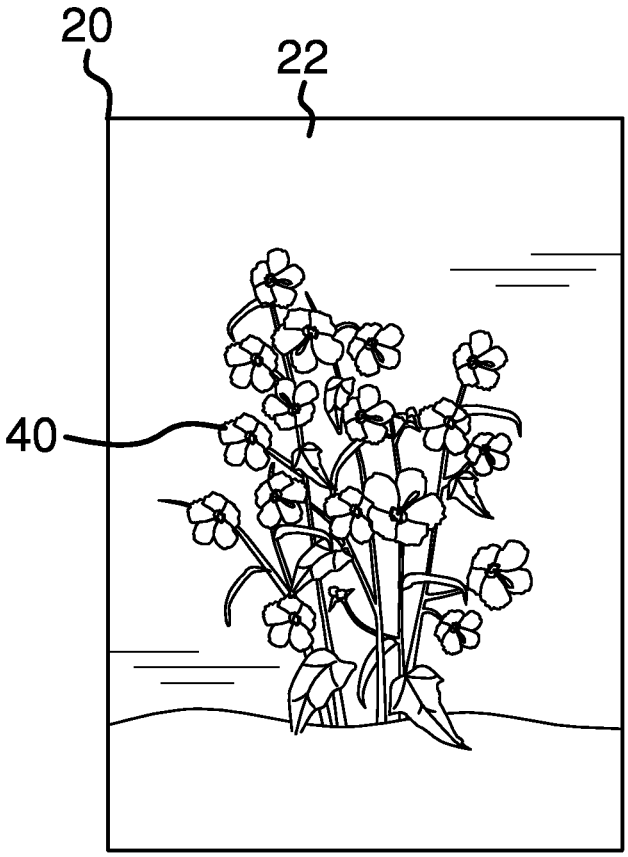
FIG. 4 is a front view of an embodiment of the disclosure.
Figure 5:
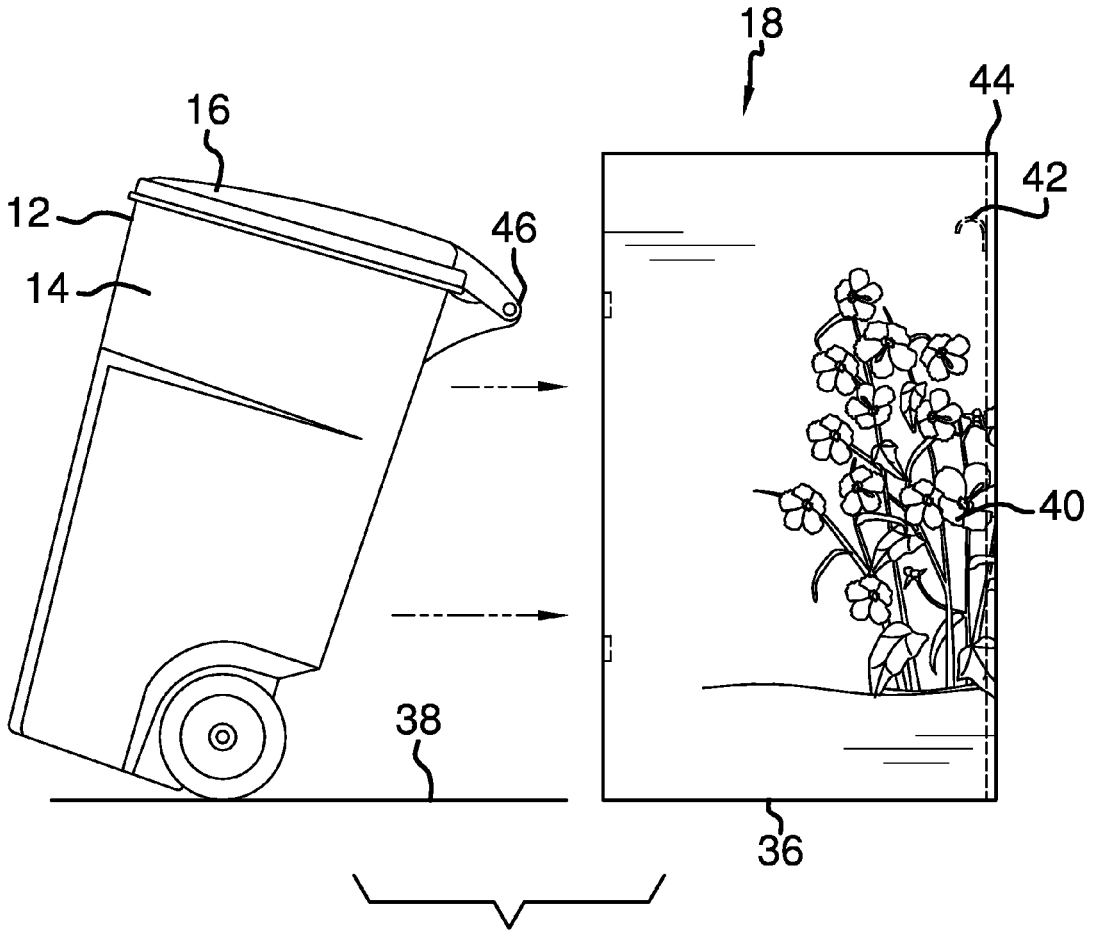
FIG. 5 is a right side view of an embodiment of the disclosure.

With reference now to the drawings, and in particular to FIGS. 1 through 5 thereof, a new concealment device embodying the principles and concepts of an embodiment of the disclosure and generally designated by the reference numeral 10 will be described.

As best illustrated in FIGS. 1 through 5, the trash container concealment system 10 generally comprises a trash container 12 that has a body 14 and a lid 16 hingedly coupled to the body 14. The trash container 12 may be a trash can or the like. A shielding apparatus 18 is positioned around the trash container 12 to conceal the trash container 12.

The shielding apparatus 18 comprises a panel 20 that has a front side 22, a back side 24 and a peripheral edge 26 extending therebetween. The panel 20 has a central section 28 and a pair of flanking sections 30 each extending rearwardly away from the central section 28 and each of the flanking sections 30 has a distal end 32 with respect to the central section 28. The flanking sections 30 are spaced apart from each other to define a space 34 between the flanking sections 30.

A bottom side 36 of the peripheral edge 26 may abut a support surface 38. The support surface 38 may be ground. The trash container 12 is positioned between the flanking sections 30 such that the panel 20 surrounds the trash container 12. The front side 22 has indicia 40 printed thereon. The indicia 40 may comprise images of flowers or other visually appealing imagery. The indicia 40 serves to beautify the presence of the trash container 12.

A clip 42 is coupled to the back side 24 corresponding to the central section 28. The clip 42 is positioned adjacent to a top side 44 of the peripheral edge 26. The clip 42 engages a hinge 46 on the trash container 12 when the trash container 12 is positioned between the flanking sections 30. The clip 42 may be one of a pair of clips 42.

A strap 48 is coupled to the back side 24 and extends between the flanking sections 30. The strap 48 is positioned adjacent the distal ends 32 and the strap 48 has a break 50 therein to define a free end 52 of each of a first portion 54 and a second portion 56. A pair of couplers 58 is each coupled to the free end 52 of one of the first portion 54 and the second portion 56. The couplers 58 are complementary and the strap 48 prevents the flanking sections 30 from being moved away from the trash container 12 when the trash container 12 is positioned in the space 34.

In use, the panel 20 is placed in an area where the trash container 12 is utilized. The trash container 12 is placed in the space 34 between the flanking sections 30. The clip 42 engages the hinge 46 on the trash can 12 to retain the panel 20 on the trash can 12. The couplers 58 are coupled together so the flanking sections 30 are retained proximate the trash can 12. The couplers 58 are uncoupled from each other, the clip 42 is removed from the hinge 46 and the trash container 12 is removed from the space 34 when the trash container 12 is to be emptied. The trash container 12 is utilized in the convention of trash containment while the panel 20 surround the trash container 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A trash container concealment system, said system comprising:

a trash container having a body and a lid hingedly coupled to said body;

a shielding apparatus positioned around said trash container to conceal said trash container, said shielding apparatus comprises a panel having a front side, a back side and a peripheral edge extending therebetween, said panel having a central section and a pair of flanking sections extending rearwardly away from said central section, each of said flanking sections having a distal end with respect to said central section, said flanking sections being spaced apart from each other to define a space between said flanking sections, a bottom side of said peripheral edge being configured to abut a support surface, said trash container being positioned between said flanking sections such that said panel surrounds said trash container, said front side having indicia printed thereon;

a clip coupled to said back side corresponding to said central section, said clip engaging a hinge on said trash container when said trash container is positioned between said flanking sections; and a strap coupled to said back side, said strap extending between said flanking sections, said strap being positioned adjacent said distal ends, said strap having a break therein to define a free end of each of a first portion and a second portion.

2. A trash container concealment system, said system comprising:

a trash container having a body and a lid hingedly coupled to said body;

a shielding apparatus positioned around said trash container to conceal said trash container, said shielding apparatus comprising:

a panel having a front side, a back side and a peripheral edge extending therebetween, said panel having a central section and a pair of flanking sections extending rearwardly away from said central section, each of said flanking sections having a distal end with respect to said central section, said flanking sections being spaced apart from each other to define a space between said flanking sections, a bottom side of said peripheral edge being configured to abut a support surface, said trash container being positioned between said flanking sections such that said panel surrounds said trash container, said front side having indicia printed thereon;

a clip coupled to said back side corresponding to said central section, said clip engaging a hinge on said trash container when said trash container is positioned between said flanking sections;

a strap coupled to said back side, said strap extending between said flanking sections, said strap being positioned adjacent said distal ends, said strap having a break therein to define a free end of each of a first portion and a second portion; and a pair of couplers each coupled to said free end of one of said first portion and said second portion, said couplers being complementary, said strap preventing said flanking sections from being moved away from said trash container when said trash container is positioned in said space.

* * * * *